United States Patent [19]

Freese

[11] 4,274,493

[45] Jun. 23, 1981

[54] CUSHIONED BULLDOZER BLADE

[75] Inventor: Gary P. Freese, Joliet, Ill.

[73] Assignee: Caterpillar Tractor Co., Peoria, Ill.

[21] Appl. No.: 969,027

[22] Filed: Dec. 13, 1978

[51] Int. Cl.[3] ..... E02F 3/76

[52] U.S. Cl. ..... 172/816

[58] Field of Search ..... 172/801, 809, 803, 808, 172/807, 805, 804, 276; 37/42 UL

[56] References Cited

U.S. PATENT DOCUMENTS

| | | | |
|---|---|---|---|
| 1,977,817 | 10/1934 | Bird | 174/804 X |
| 2,029,545 | 2/1936 | Ross | 172/801 X |
| 2,160,596 | 5/1939 | Le Bleu | 172/804 |
| 2,919,142 | 12/1959 | Winget | 172/276 |
| 3,158,944 | 12/1964 | Rehberg | 172/801 |
| 3,226,858 | 1/1966 | Spannhake | 172/801 X |
| 3,238,647 | 3/1966 | Hall | 172/801 |
| 3,825,074 | 7/1974 | Stedman | 172/803 |
| 3,964,803 | 6/1976 | Eftefield | 172/801 |
| 4,031,968 | 6/1977 | Krolak | 172/801 |
| 4,074,896 | 2/1978 | Eftefield | 172/803 |

FOREIGN PATENT DOCUMENTS

| | | | |
|---|---|---|---|
| 1132734 | 11/1968 | United Kingdom | 172/801 |

*Primary Examiner*—Richard J. Johnson

*Attorney, Agent, or Firm*—Phillips, Moore, Weissenberger, Lempio & Majestic

[57] ABSTRACT

The push arms (17) of a bulldozer assembly (12) are mounted outboard of the track roller frames (18) of a tractor (11) and a cushioning cylinder (20) is interconnected between each push arm (17) and track roller frame (18). This arrangement thus avoids the problem of imposing loads on the main frame (15) of the tractor to which the push arms (17) are normally connected and permits cushioned loads to be transmitted to a pivot shaft (45) pivotally mounting the track roller frames (18) on the main frame (15).

13 Claims, 4 Drawing Figures

CUSHIONED BULLDOZER BLADE

DESCRIPTION

1. Technical Field

This invention relates to construction vehicles and more particularly relates to cushioning means employed in association with the push arms of a bulldozer assembly for absorbing forces imposed on the blade thereof.

2. Background Art

The push arms of a conventional bulldozer assembly are normally connected to the main frame of a tractor which tends to unduly load the frame during tractor operation. One solution to this loading problem has been the provision of a cushioning link interconnected between each push arm and the main frame of the tractor to absorb loads. This arrangement still induces a degree of loading on the main frame and makes the assembly and servicing of the link and attendant structures difficult, due to the inaccessibility thereof. Although the prior art suggests connecting the push arms to the track roller frames of the tractor to thus eliminate direct loading of the main frame thereof, such prior art is silent with respect to providing cushioning means therebetween.

DISCLOSURE OF THE INVENTION

The present invention is directed to overcoming one or more of the problems as set forth above.

In one aspect of this invention, a vehicle comprises a main frame, a pair of sub-frames, pivot means for pivotally mounting the sub-frames on either side of the main frame, a work tool, a push arm interconnected between the work tool and one of the sub-frames and the pivot means, and cushioning means connecting the push arm with one of the sub-frames and the pivot means for absorbing forces imposed on the push arm.

The cushioning means comprises a cushioning cylinder interconnected between the vehicle and the push arm and lost-motion means for permitting reciprocal movement of the push arm. The cushioning cylinder is dependent of the lost-motion means.

The above disposition of the cushioning means provides for efficient absorption of forces imposed on the work tool and also renders the cushioning means readily available for servicing purposes.

BRIEF DESCRIPTION OF THE DRAWINGS

Other objects of this invention will become apparent from the following description and accompanying drawings wherein.

BEST MODE FOR CARRYING OUT THE INVENTION

Figure 1:
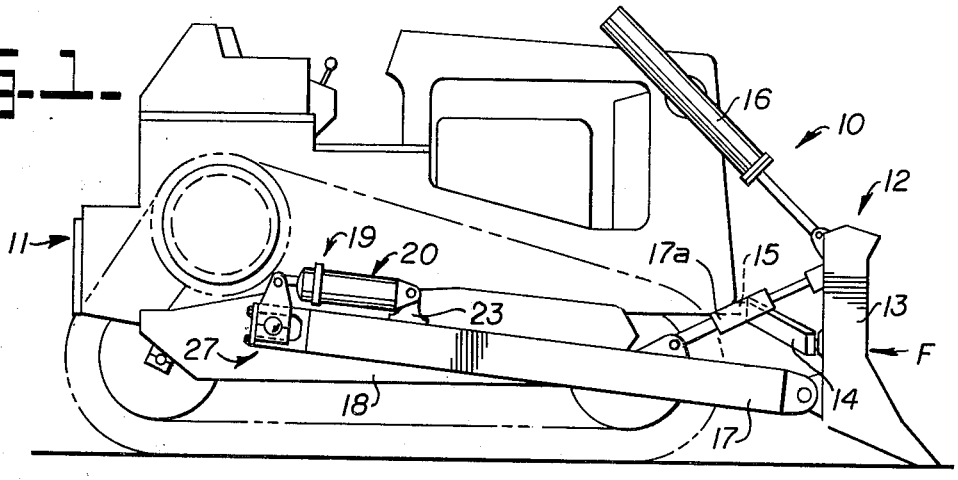
FIG. 1 is a side elevational view of a track-type tractor having a bulldozer assembly mounted thereon and a cushioning means embodiment of the present invention incorporated therein.

FIG. 1 illustrates a construction vehicle 10 which may comprise a track-type tractor 11 having a bulldozer assembly 12 mounted thereon. The bulldozer assembly comprises a work tool 13, such as the illustrated bulldozer blade. The bulldozer blade may be used in a conventional manner to push earth or the like or to be used as a push-dozer for pushing another construction vehicle, such as a tractor-scraper. A tag link 14 is pivotally interconnected between blade 13 and a main frame 15 of tractor 11 to function in a conventional manner to transmit side loads imposed on the blade to the main frame directly to thus eliminate the need for conventional diagonal bracing.

A pair of double-acting lift cylinders 16 (one shown) are pivotally interconnected between tractor 11 and blade 13 to selectively raise or lower the blade in a conventional manner. A pair of laterally spaced and rearwardly extending push arms 17 preferably have their forward ends pivotally mounted on push arms and a tilt brace or cylinder 17*a* is pivotally interconnected between each push arm and the blade in a conventional manner. Alternatively, tilt braces 17*a* could be eliminated and push arms 17 secured directly to blade 13, if so desired.

Figure 2:
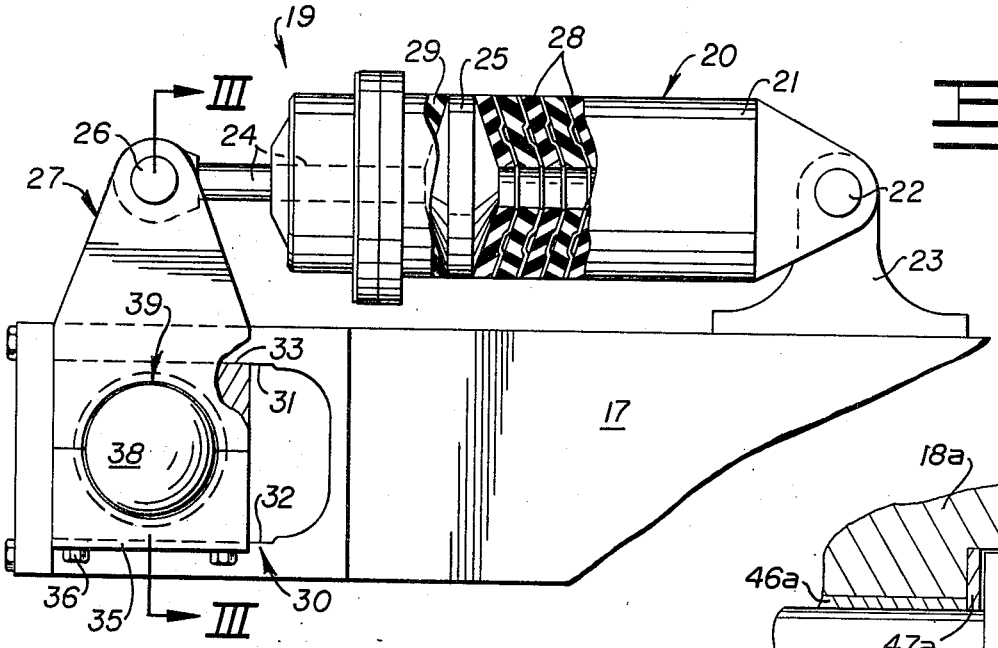
FIG. 2 is an enlarged and partially sectioned side elevational view of the cushioning means.
Figure 3:
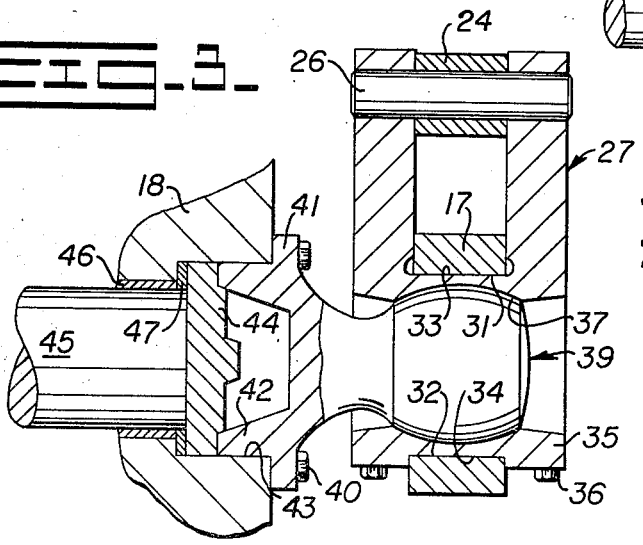
FIG. 3 is a sectional view, taken in the direction of arrows III—III in FIG. 2.

As more clearly shown in FIGS. 2 and 3, the rearward end of each push arm 17 is mounted on a track roller or sub-frame 18 of tractor 11 by cushioning means 19. Cushioning means 19 functions to efficiently absorb forces F (FIG. 1) imposed on blade 13 during operation of vehicle 10, regardless of the point of application of such forces on the blade. Cushioning means 19 comprises a cushioning cylinder 20 having a housing 21 thereof pivotally connected by a pin 22 to a bracket 23 secured to push arm 17. It should be noted that cylinder 20 is preferably mounted in parallel relationship with respect to the longitudinal axis of push arm 17 and is further mounted on the upper side thereof.

This disposition of cushioning cylinder 20 facilitates in-line reception of forces F, imposed on blade 13 and push arm 17, places the cylinder in a generally protected position, and facilitates assembly and servicing thereof. A rod 24, having an annular thrust member 25 secured on one end thereof, is reciprocally mounted in housing 21 and has a second end thereof pivotally connected by a pin 26 to a bifurcated bracket 27. Two sets of cup-shaped elastomeric cushioning pads 28 and 29 are mounted in housing 21, on either side of thrust member 25, to cushion relative reciprocal movements of housing 21 and rod 24 in a conventional manner. Further details on cushioning cylinder 20 may be obtained from U.S. Pat. No. 4,074,896, issued on Feb. 21, 1978 to Larry G. Eftefield, such patent being assigned to the assignee of this application.

Cushioning means 19 further comprises lost-motion means 30 including an elongated slot defined on an end of push arm 17 by a pair of parallel and flat bearing surfaces 31 and 31. As shown in FIG, 3, these bearing surfaces slidably engage flat bearing surfaces 33 and 34, respectively, to permit reciprocation of push arm 17 in the direction of its generally disposed longitudinal axis, relative to bracket 27.

As further shown in FIGS. 2 and 3, bracket 27 comprises a cap 35, defining bearing surface 34 thereon, which is releasably secured in place by a plurality of bolts 36. Bracket 27 has a socket 37 defined therein which conforms to a semi-spherical ball 38 of a support member 39 which is secured to an outboard side of sub-frame 18 by a plurality of bolts 40 which extend through a flange 41 of the support member. Support member 39 further comprises an annular boss 42 which is disposed in a bore 43, defined in sub-frame 18. Bore 43 further receives an annular member 44 which is welded or otherwise suitably secured to an end of a pivot shaft 45 mounted in a conventional manner on main frame 15 of tractor 11 (FIG. 1).

Pivot shaft 45 functions to pivotally mount each track roller or sub-frame 18 on main frame 15 to permit relative pivotal movements therebetween upon operation of vehicle 10. It should be noted that support member 39 is preferably disposed in axial alignment with respect to the longitudinal axis of pivot shaft 45 whereby forces imposed on the support member by push arm 17 are transmitted substantially directly to pivot shaft 45. A sleeve bearing 46 is preferably mounted between sub-frame 18 and pivot shaft 45 to facilitate relative pivotal movements therebetween whereas an annular thrust bearing 47 is preferably mounted between the sub-frame and member 44 to counteract any lateral thrust loads which may be imposed thereon.

Figure 4:
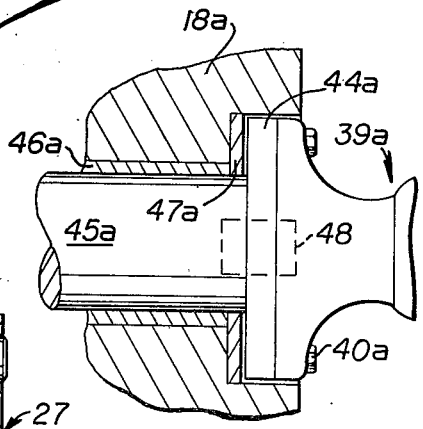
FIG. 4 is a view similar to FIG. 3, illustrating a modification of mounting means for mounting the bulldozer assembly on the tractor.

FIG. 4 illustrates a modification of the means for mounting bracket 27 of sub-frame 18 and wherein identical numerals depict corresponding constructions, but with such numerals being accompanied by an "a" in FIG. 4 to indicate modified constructions. In particular, a support member **39*a* is secured to an annular member 44*a* by a plurality of bolts 40*a* with member 44*a* being welded or otherwise suitably secured to a pivot shaft 45*a* to form an integral part thereof. Pivot shaft 45*a* functions in an identical manner to previously described pivot shaft 45 to mount pivotally a slightly modified sub-frame 18*a* on main frame 15 of the tractor. Sleeve and thrust bearings 46*a* and 47*a*, respectively, are also preferably employed in the FIG. 4 modification. If so desired, an annular shear block or pin 48 may be suitably mounted in members 39*a* or 44*a* and pivot shaft 45*a* to further aid in transmitting forces imposed on support member 39*a* by push arm 17 directly to pivot shaft 45*a***.

Industrial Applicability

Cushioning means 19 is particularly useful on any vehicle wherein it is desired to cushion forces imposed on push arms thereof, such push arms having a work tool mounted forwardly thereon. Cushioning means 19 finds particular application to vehicle 10 in FIG. 1 which comprises a tractor 11having push arms 17 of a bulldozer assembly 12 mounted thereon in the manner described above. As discussed above, although conventional vehicles of this type have employed various types of cushioning means between the push arms and main frame of the tractor thereof, the connection of the push arms to such main frame transmits undesirable forces to the main frame. Furthermore, although the prior art suggests the mounting of the push arms to the track roller frames of a tractor in the vicinity of the pivot shaft for pivotally mounting the track roller frames on the main frame of the tractor, no cushioning mechanism is provided to cushion the loads imposed thereon.

In applying cushioning means 19 of this invention to vehicle 10, it should be noted that forces F imposed on blade 13 are transmitted "in-line" through each push arm 17 and to cushioning cylinder 20. Leftward movement of push arm 17 and housing 21 of cylinder 20 in FIG. 2 will function to compress first set of pads 28 against thrust member 25 whereby such forces are substantially absorbed by the cylinder. It should be further noted that lost-motion means 30, also comprising part of cushioning means 19, will permit relative movement of push arms 17 with respect to bracket 27 which is secured to support member 39.

Since support member 39 is secured to sub-frame 18 and is preferably aligned axially with respect to pivot shaft 45, any forces transmitted to support member 39 will be transmitted substantially directly to pivot shaft 45. The rebound or rightward movement of push arm 17, relative to bracket 27, will function to compress thrust member 25 against second set of pads 29 to dampen rebound forces to prevent any potential damage to the illustrated structures. As discussed above, the modification illustrated in FIG. 4 functions in a substantially similar manner, except the support member **39*a* is secured directly to pivot shaft 45*a***.

Other aspects, objects and advantages of this invention can be obtained from a study of the drawing, the disclosure, and the appended claims.

I claim:

1. In a vehicle, (10) comprising a main frame (15), a sub-frame (18) disposed on each outboard side of said main frame (15), pivot means (45) for pivotally mounting said sub-frame (18) on said main frame (15), a work tool (13) disposed forwardly of said main frame (15), a push arm (17) disposed on an outboard side of said sub-frame (18) and having first and second ends interconnected directly between said work tool (13) and one of said sub-frame (18) and said pivot means (45), respectively, the improvement comprising cushioning means (19) for directly absorbing pushing forces imposed on said push arm (17), said cushioning means (19) including a cushioning cylinder (20) having a first end connected directly to said push arm (17) and a second end connected to one of said sub-frame (18) and said pivot means (45), and lost-motion means (30) for connecting the second end of said push arm (17) on said sub-frame (18) and for permitting reciprocal movement of said push arm (17) on and relative to said sub-frame (18), said cushioning cylinder (20) being independent of said lost-motion means (30).

2. The vehicle of claim 1 wherein said cushioning cylinder (20) includes a housing (21) connected to said push arm (17) and a rod (24) connected to one of said sub-frame (18) and said pivot means (45).

3. The vehicle of claim 2 wherein said cushioning cylinder (20) is disposed in at least approximate parallel relationship, relative to said push arm (17).

4. The vehicle of claim 2 wherein said cushioning means (19) further includes a support member (39) secured to one of said sub-frame (18) and said pivot means (45), a bracket (27) secured to said support member (39) and wherein said cylinder (20) is interconnected between said push arm (17) and said bracket (27).

5. The vehicle of claim 4 wherein said support member (39) is secured directly to said sub-frame (18).

6. The vehicle of claim 4 wherein said support member (39) is secured directly to said pivot means (45).

7. The vehicle of claim 4 wherein said lost-motion means (30) includes a pair of parallel bearing surfaces (31, 32) defining a lost-motion slot and wherein said bracket (27) includes a pair of parallel bearing surfaces (33, 34) engaged in bearing contact with the parallel bearing surface (31, 32) of said lost-motion means (30).

8. In a tractor (11) having rigid push arms (17) of a bulldozer assembly (12) mounted thereon, the improvement comprising cushioning cylinder means (20) for directly cushioning reciprocal movement of each said push arm (17) relative to said tractor (11) and lost-motion means (30) for simultaneously permitting compression of said cushioning cylinder means (20) and said movement of said push arm (17), a first end of said cushioning cylinder means (19) being connected directly to said push arm (17) and a second end thereof being connected directly to said tractor, said cushioning cylinder means (20) being laterally spaced from and independent of said lost-motion means (30).

9. The tractor (11) of claim 8 wherein said cushion cylinder means (20) is disposed in at least approximate parallel relationship relative to said push arm (17).

10. The tractor of claim 8 further including a support member (39) secured to said tractor (11), a bracket (27) secured to said support member (39) and wherein said cushion cylinder means (20) is interconnected between said push arm (17) and said bracket (27).

11. The tractor (11) of claim 10 wherein said lost-motion means (30) includes a pair of parallel bearing surfaces (31, 32) defining a lost-motion slot and wherein said bracket (27) includes a pair of parallel bearing surfaces (31, 32) of said lost-motion means (30).

12. In a vehicle (10) comprising a main frame (15), a sub-frame (18) disposed on each outboard side of said main frame (15), pivot means (45) for pivotally mounting said sub-frame (18) on said main frame (15), a work tool (13) disposed forwardly of said main frame (15), a push arm (17) disposed on an outboard side of said sub-frame (18) and interconnected between said work tool (13) and one of said sub-frame (18) and said pivot means (45), the improvement comprising cushioning means (19) for connecting said push arm (17) directly with one of said sub-frame (18) and said pivot means (45) and for absorbing forces imposed on said push arm (17), said cushioning means including lost-motion means (30) for permitting reciprocal movement of said push arm (17) relative to said sub-frame (18), a cushioning cylinder (20) independent of said lost-motion means (30), a support member (39) secured directly to said pivot means (45), and a bracket (27) secured to said support member (39) and wherein said cylinder (20) is interconnected between said push arm (17) and said bracket (27).

13. In a vehicle (10) comprising a main frame (15), a sub-frame (18) disposed on each outboard side of said main frame (15), pivot means (45) for pivotally mounting said sub-frame (18) on said main frame (15), a work tool (13) disposed forwardly of said main frame (15), a push arm (17) disposed on an outboard side of said sub-frame (18) and interconnected between said work tool (13) and one of said sub-frame (18) and said pivot means (45), the improvement comprising cushioning means (19) connecting said push arm (17) directly with one of said sub-frame (18) and said pivot means (45) for absorbing forces imposed on said push arm (17), said cushioning means (19) including a cushioning cylinder (20), a support member (39) secured to one of said sub-frame (18) and said pivot means (45), a bracket (27) secured to said support member (39), said cylinder (20) being interconnected between said push arm (17) and said bracket (27), and lost-motion means (30) for permitting reciprocal movement of said push arm (17) relative to said sub-frame (18), said lost-motion means (30) including a pair of parallel bearing surfaces (31,32) defining a lost-motion slot and wherein said bracket (27) includes a pair of parallel bearing surfaces (33,34) engaged in bearing contact with the parallel bearing surfaces (31,32) of said lost-motion means (30).

* * * * *